US010011963B2

(12) United States Patent
Eaton et al.

(10) Patent No.: US 10,011,963 B2
(45) Date of Patent: Jul. 3, 2018

(54) CROWD CONTROL STANCHION WITH CHAIN STORAGE

(71) Applicant: Indian Industries, Inc., Evansville, IN (US)

(72) Inventors: James Eaton, Sleepy Hollow, IL (US); Ryan Hahn, Dieterich, IL (US)

(73) Assignee: Indian Industries, Inc., Evansville, IN (US)

( * ) Notice: Subject to any disclaimer, the term of this patent is extended or adjusted under 35 U.S.C. 154(b) by 378 days.

(21) Appl. No.: 14/794,290

(22) Filed: Jul. 8, 2015

(65) Prior Publication Data

US 2017/0009412 A1 Jan. 12, 2017

(51) Int. Cl.
*E04H 17/00* (2006.01)
*E01F 13/02* (2006.01)

(52) U.S. Cl.
CPC ..... *E01F 13/028* (2013.01)

(58) Field of Classification Search
CPC ..... E04H 17/00; E04H 17/02; E04H 17/0022; E04H 17/04; E04H 17/06; E04H 17/08; E04H 17/20; E04H 17/22; E01F 13/02; E01F 13/024; E01F 13/028; E01F 15/00; E01F 15/003; Y10T 16/473; Y10T 403/32467; Y10T 403/32475; Y10T 403/32508; Y10T 403/32549; Y10T 403/32581; Y10T 24/39; Y10T 24/3902; Y10T 24/3969; Y10T 24/3984; B65H 2701/374
USPC ..... 256/146, 48, 65.14, DIG. 5, 1, 46, 256/DIG. 55; 403/13, 109.1, 109.2, 403/109.4, 109.6, 112, 116; 52/300; 160/332; 404/6, 9; 206/348; 215/356, 215/222, 355
See application file for complete search history.

(56) References Cited

U.S. PATENT DOCUMENTS 2,315,516 A 4/1943 Gray
2,618,922 A * 11/1952 Johnson ..... F16G 13/10 403/122
3,471,129 A * 10/1969 Mpakarakes ..... E04H 17/18 256/24
3,891,189 A * 6/1975 Russo ..... E04H 12/2215 256/1
3,990,182 A * 11/1976 Linder ..... E01F 13/028 49/34
4,533,122 A 8/1985 Bannister
4,657,402 A * 4/1987 Dupuis ..... B65D 88/68 222/228
4,844,420 A 7/1989 Oster
5,452,542 A 9/1995 Bardwell
5,537,778 A 7/1996 Bardwell et al.
6,192,627 B1 2/2001 Gompertz et al.
6,349,503 B1 * 2/2002 Gompertz ..... E01F 13/028 49/34

(Continued)

*Primary Examiner* — Amber Anderson
*Assistant Examiner* — Nahid Amiri
(74) *Attorney, Agent, or Firm* — Woodard, Emhardt, Moriarty, McNett & Henry, LLP; Charles Meyer

(57) ABSTRACT

A stanchion includes storage for a linkage member. The stanchion includes a hollow pole and a cap piece inserted into the top portion of the pole. Vertical movement of the cap piece may provide clearance for a linkage opening to allow the linkage member to be pulled from or pushed into the interior of the hollow pole.

20 Claims, 7 Drawing Sheets

(56) References Cited

U.S. PATENT DOCUMENTS 6,364,381 B1 * 4/2002 Schmidt ..... E01F 13/028 248/304
6,375,164 B1 * 4/2002 Siegler ..... E01F 13/028 256/1
6,682,055 B1 1/2004 Tomlinson et al.
6,776,398 B1 8/2004 Tsai
6,830,236 B2 12/2004 de Lorenzo
6,845,589 B1 * 1/2005 Thompson ..... E05B 65/0007 49/34
6,969,050 B1 11/2005 Loebner
7,178,790 B2 2/2007 de Lorenzo
D556,915 S * 12/2007 Tuncel ..... E01F 13/046 D25/48.6
7,909,310 B2 3/2011 Weiner
7,967,233 B2 6/2011 de Lorenzo
7,980,781 B2 * 7/2011 Trice ..... B25G 1/04 403/109.3
8,087,846 B2 * 1/2012 Ringelberg ..... E01F 13/028 404/6
8,261,806 B2 9/2012 Wettern
8,568,246 B2 * 10/2013 Wall ..... A63B 53/10 403/109.1
9,004,015 B2 * 4/2015 Krieger ..... A01K 1/04 119/786
2002/0063248 A1 * 5/2002 Siegler ..... E01F 13/028 256/37
2003/0111657 A1 6/2003 Green
2008/0115334 A1 * 5/2008 Chen ..... A43C 1/00 24/115 G
2009/0080971 A1 * 3/2009 Schram ..... E01F 13/046 404/6
2009/0242065 A1 * 10/2009 Whitling ..... F16B 7/042 138/120
2013/0181178 A1 * 7/2013 Akerstrom ..... E01F 15/06 256/13.1
2013/0248793 A1 9/2013 Bar-or
2014/0014760 A1 * 1/2014 Tsai ..... B65H 75/4447 242/396
2014/0212214 A1 * 7/2014 Sloan ..... E01F 13/12 404/6
2015/0218848 A1 * 8/2015 Weiner ..... E01F 13/028 256/47
2016/0326705 A1 * 11/2016 Torsiello ..... E01F 13/024

* cited by examiner

CROWD CONTROL STANCHION WITH CHAIN STORAGE

FIELD OF THE ENDEAVOR

The present disclosure deals with barrier devices.

BACKGROUND

Temporary barrier systems have many useful applications ranging from defining queue lines, preventing access to certain areas, or for general crowd control. By nature, these temporary barriers are often used for a short period of time and then returned to storage until needed for use again. Many available barrier devices include a post and a long rope, chain, or some other type of line that connects to an adjacent barrier device or exterior anchor. These long ropes or chains may take up space during storage or may be easily misplaced if stored separately from the post. Therefore, it would be beneficial to have a stanchion or post device that provides storage for the line portion of the barrier system.

SUMMARY

Certain embodiments include a stanchion that includes storage for a linkage member that may be used as part of a barrier device. The stanchion may include a base and a hollow pole extending upward from the base. A linkage member, such as a chain, may be stored within the hollow pole. The linkage member may be pulled out of the pole and attached to an exterior anchor or hook to create a barrier.

A cap piece including a lower portion and an upper portion may be introduced into a top portion of the hollow pole so that the cap piece may move vertically relative to the pole. At least one linkage opening is defined in a side of the cap piece. In a lowered position, the linkage opening is restricted. The cap piece may also be placed in a raised position to provide clearance for the linkage opening so a user may pull the linkage member through the linkage opening to a desired length or push the linkage member into the pole for storage. Once the desired length of linkage member has been removed from the pole, the cap piece may be returned to its lowered position to hold the linkage member at the desired length.

In some embodiments, movement of the cap piece relative to the pole may be constrained by a pin located in the hollow pole that engages a path with multiple path segments in the lower portion of the cap piece. Vertical movement of the cap piece is allowed when the pin is within a vertical path, where the length of the vertical path defines the height to which the cap piece may be raised. The cap may be rotated when the pin is in a horizontal path to allow the cap piece to be locked into a lowered position.

DESCRIPTION OF PREFERRED EMBODIMENTS

Figure 1:
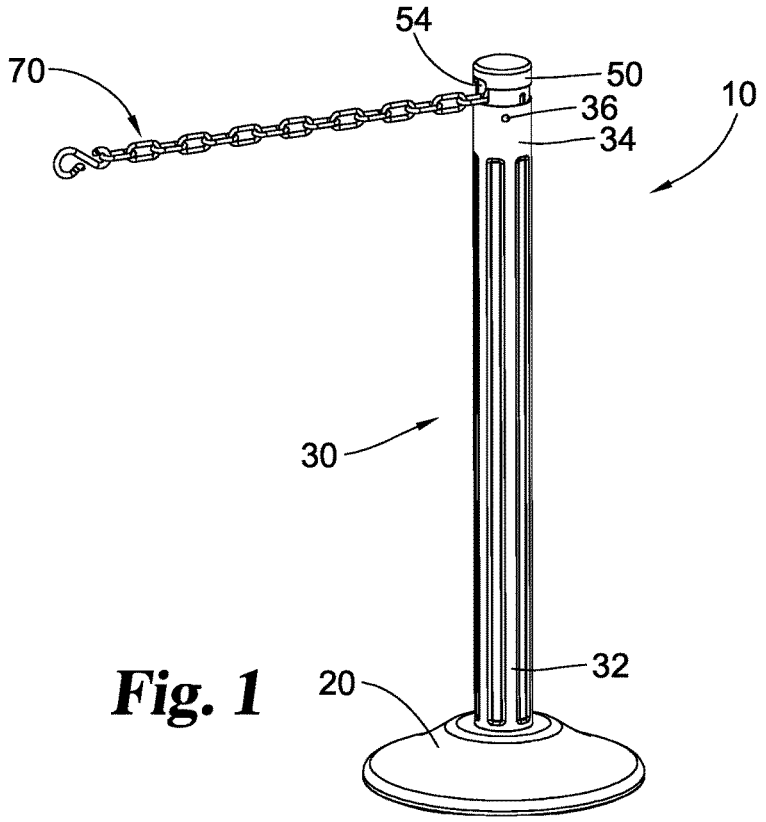
FIG. 1 is a perspective view of a stanchion with storage for a linkage member.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present disclosure pertains generally to the field of crowd control stanchions and particularly to stanchions including means for allowing a linkage member to be deployed and secured at various lengths as selected to create a barrier and means for storing the linkage member. Aspects of the present disclosure include a crowd control stanchion with a pole extending upward from a base. The pole is hollow and stores a length of chain or another type of flexible linkage member which can be pulled out of the pole and secured to a remote anchor, such as another stanchion or a wall, to define a path or a barrier in a crowd control situation such as people waiting in lines.

A cap piece with an upper portion and a lower portion is mounted to the upper end of the pole. The cap piece can be controlled in height. In one position, the cap piece may be lowered into the pole so that the entirety or a majority of the lower portion is located within the interior of the hollow pole. In another position, the cap piece may be raised from the pole so that a part of the lower portion is exposed. Raising and lowering the cap piece controls whether the linkage member may be extended from/retracted into the pole or whether it is held in place.

In certain embodiments, the cap is secured to the pole using at least one pin which extends into a path defined in a lower portion of the cap that extends inside the pole. When the pin is aligned with a vertical path segment the cap can move vertically, for example, the cap may be lowered so that the top portion of the cap is adjacent the top of the pole. When desired, the user can lift the cap a distance defined by the vertical length of the vertical path segment. The cap can also be rotated so that the pin travels along a horizontal path segment. When the pin is located in the horizontal path segment away from the vertical path segment, the cap piece and generally cannot move vertically relative to the pole.

One or more linkage openings are defined on the cap piece. Each linkage opening may be located in an open or a closed position depending on the position of the cap piece relative to the pole. Generally, when the cap piece is in a lowered position, at least a portion of the linkage opening is obstructed by the pole, and when the cap piece is in a raised position, the linkage opening is unobstructed by the pole.

A linkage member, such as a crowd control chain, rope, strap, or other type of line can be threaded through the one or more linkage openings. One end of the linkage member is typically anchored within the pole and the opposing end has a ring with a clip or a similar end piece which is larger than the linkage opening. When the cap is in the raised position, the linkage member is freely moveable and a user may pull a length of the linkage member from within the pole and may secure the outer end remotely as desired. When the linkage member has been deployed a desired length, the cap can be lowered to hold the linkage member at the desired length by restricting it between the cap and the pole so that it cannot be further pulled or pushed. When storage is desired, the cap can be moved to the raised position, providing clearance for the linkage opening, so a portion of the linkage opening that is unobstructed by the pole is large enough to allow a user to feed the linkage member inward to the pole as desired for all but the end piece. The cap can then be lowered to lock the linkage member within the pole.

FIG. 1 illustrates an example of a stanchion 10 with storage for a linkage member 70. Stanchion 10 includes a base 20 and a hollow pole 30. Pole 30 is typically cylindrical with a wall defining an outer diameter and an inner diameter extending upward from base 20. Alternately, other pole shapes may be used. The bottom portion 32 of pole 30 is attached to base 20. A cap piece 50 is inserted into the top portion 34 of hollow pole 30. Stanchion 10 also contains a linkage member 70. As illustrated, linkage member 70 may be a chain, or in other embodiments, linkage member 70 may be lengths of suitable material, such as a rope, a strap, a ribbon, or a nylon cord. One part of linkage member 70 is located within hollow pole 30 while another part of linkage member 70 extends outside of hollow pole 30. A middle portion of linkage member 70 extends through a linkage opening 54 defined in cap piece 50.

Figure 2:
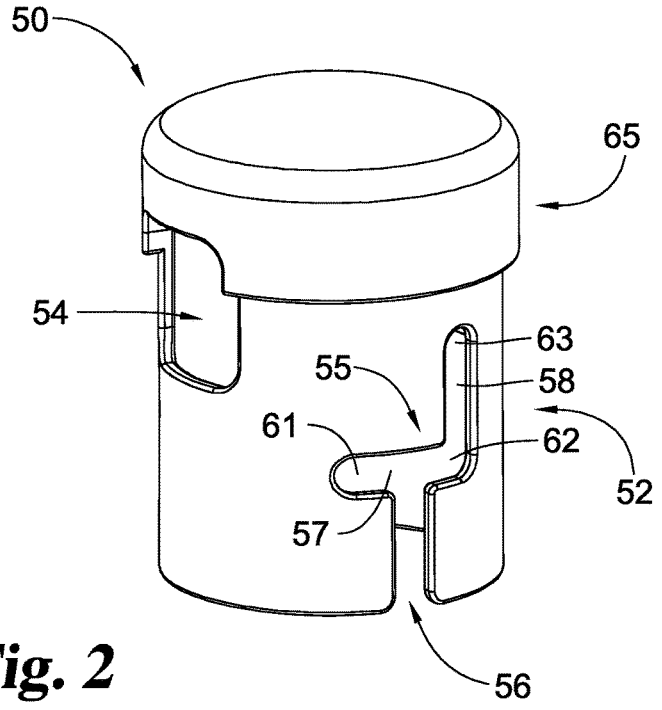
FIG. 2 is a perspective view of a cap piece of the stanchion of FIG. 1.

A representative embodiment of cap piece 50 is shown in FIG. 2. Cap piece 50 includes a lower portion 52 and an upper portion 65. Lower portion 52 has an outer diameter that is approximately the same as and fits within the inner diameter of pole 30. Upper portion 65 has an outer diameter larger than the diameter of lower portion 52 and the inner diameter of pole 30. In some embodiments, the outer diameter of upper portion 65 may be the same as the outer diameter of pole 30. A linkage opening 54 is defined through cap piece 50. In some embodiments, linkage opening 54 is only in lower portion 52; however, in other embodiments, linkage opening 54 spans both the lower portion 52 and upper portion 65. In some embodiments, cap piece 50 may contain more than one linkage opening 54. For example, there may be two diametrically opposed linkage openings 54 (see FIG. 3) or there may be three or four linkage openings.

Lower portion 52 of cap piece 50 also defines a path 55 that engages a pin 36 located in the top portion 34 of pole 30. Pin 36 extends from the inner diameter of pole 30 into the interior of pole 30. Pin 36 remains stationary while cap piece 50 is inserted into, rotated within, or raised and lowered into hollow pole 30. It should be understood, that as cap piece 50 moves within pole 30, pin 36 and pole 30 remain stationary. Discussion of movement herein describes the relative position of cap piece 50 to pole 30 and pin 36.

The interaction between path 55 and pin 36 limits the movement of cap piece 50 when lower portion 52 is inserted into hollow pole 30. An entry path segment 56 extends from the bottom edge of cap piece 50. The upper end of entry path segment 56 forms a T-shape with a horizontal path segment 57. A vertical path segment 58 extends vertically from an end of horizontal path 57. Alternatively, other shapes and arrangements for the path may be used.

As shown, cap piece 50 only has paths 55; however, in other embodiments, cap piece 50 may include two or more coordinated paths 55. In embodiments where there is more than one path 55, hollow pole 30 has a matching number of pins 36 that are oriented to correspond with the position of entry path segments 56 on cap piece 50.

Figure 3:
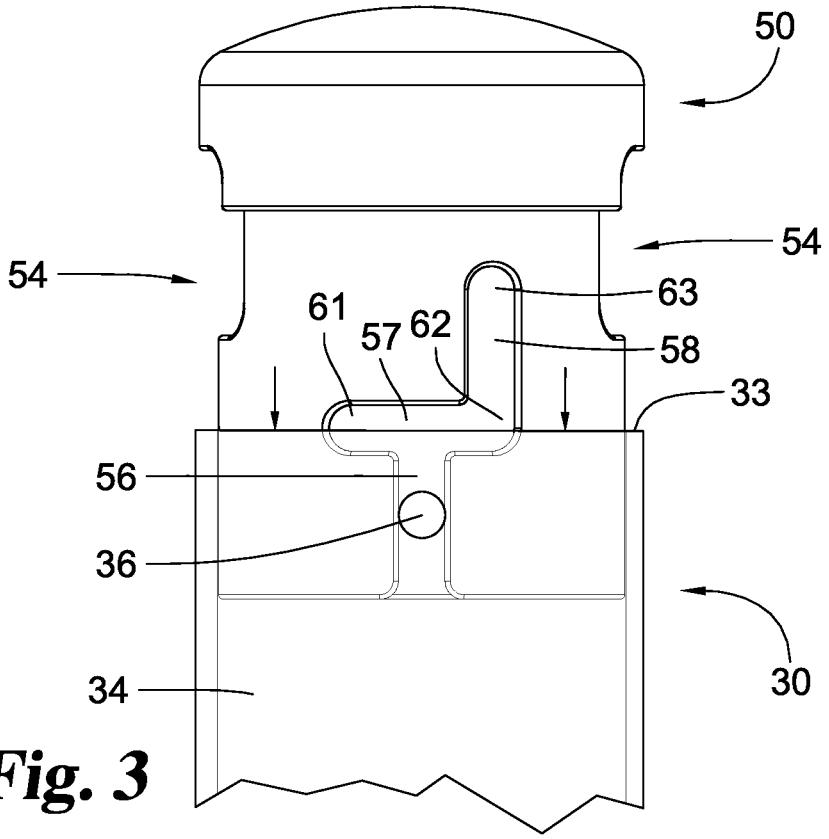
FIG. 3 is a side view of the cap piece of the stanchion of FIG. 1 where the pin is located in the alignment path.

As seen in FIG. 3, cap piece 50 may be lowered into the top portion 34 of hollow pole 30 by aligning entry path segment 56 with pin 36. This allows lower portion 52 of cap piece 50 to slide downward, into hollow pole 30 as pin 36 moves upward within entry path segment 56. It should be noted that various figures, like FIG. 3, show internal aspects for ease of explanation.

Figure 4:
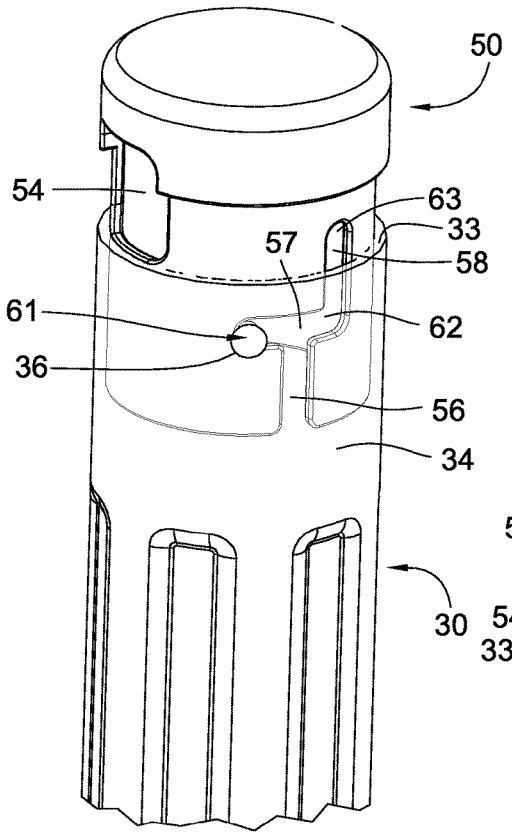
FIG. 4 is a perspective view of the cap piece of the stanchion of FIG. 1 where the cap piece is in a raised position.

Once cap piece 50 has been inserted into hollow pole 30 far enough to allow for pin 36 to clear entry path segment 56, pin 36 enters horizontal path segment 57. Cap piece 50 is able to rotate when pin 36 is located in horizontal path segment 57. When cap piece 50 is rotated so pin 36 moves relative to horizontal path segment 57 in the direction away from vertical path segment 58 (counterclockwise in a top-down perspective relative to FIG. 3) to horizontal end 61, cap piece 50 is retained in a raised position (see FIG. 4). In the raised position, having pin 36 located at horizontal end 61 of horizontal path 57 prevents cap piece 50 from moving vertically, so cap piece 50 cannot be raised or lowered in hollow pole 30.

When cap piece 50 is in the raised position, there is clearance between linkage opening 54 and the upper edge 33 of the top portion 34 of hollow pole 30, so at least a portion of linkage opening 54 is unobstructed by pole 30. When the clearance between linkage opening 54 and top portion 34 is larger than the cross-sectional area of the linkage member 70, a desired length of linkage member 70 is allowed to be inserted into or removed from hollow pole 30.

Figure 5:
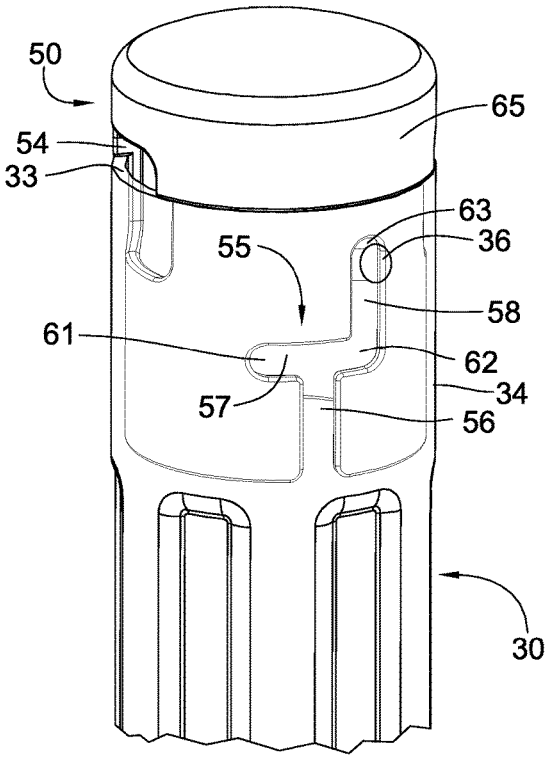
FIG. 5 is a perspective view of the cap piece of the stanchion of FIG. 1 where the cap piece is in a lowered position.

If cap piece 50 is rotated in the opposite direction (clockwise from top-down reference to FIG. 3) toward point 62 where horizontal path segment 57 meets vertical path segment 58, pin 36 is introduced into vertical path segment 58. When pin 36 is located in vertical path segment 58 at point 62, cap piece 50 may be pushed further downward, into hollow pole 30 so cap piece 50 is in a lowered position (see FIG. 5). Cap piece may be lowered within pole 30 until pin 36 reaches vertical path end 63. When pin 36 is located at any portion within vertical path segment 58, except at point 62, cap piece 50 is prevented from rotating. In some embodiments, the upper portion 65 of cap piece 50 may rest on top portion 34 of pole 30 when cap piece 50 is in the lowered position, so the bottom edge of upper portion 65 abuts the edge of top portion 34. In other embodiments, the portion of cap piece 50 that may be inserted into hollow pole 30 is limited by the length of vertical path segment 58.

In some embodiments, cap piece 50 may be retained in the lowered position using only gravity or a friction fit of the cap piece 50 contacting the inner diameter of pole 30. However, other embodiments may have additional mechanisms that may keep cap piece 50 in a lowered position. Devices such as a physical locking mechanism or a biasing mechanism that biases the cap downward, such as a spring or elastic cords inside the pole, may be included to assist in maintaining cap piece 50 in the lowered position. Other embodiments may include an additional horizontal path segment extending adjacent to vertical path segment 58 at end 63. Pin 36 may be rotated into this additional horizontal path segment, so cap piece 50 is retained in the lowered position.

When cap piece 50 is located in its lowered position, only a portion of linkage opening 54 is provided clearance from hollow pole 30, restricting the movement of linkage member 70 into and out of linkage opening 54. This restriction of movement can be the result of the pole wall partially covering the linkage opening and thereby limiting the portion of linkage opening 54 that is unobstructed. The remaining opening size prevents linkage member 70 from moving. Alternately, cap piece 50 and pole 30 may apply pressure on linkage member 70 to prevent a user from pushing or pulling linkage member 70. This acts as a locking feature that keeps linkage member 70 at a fixed length. In embodiments where the linkage member 70 is a chain, the clearance may be approximately equal to the cross-sectional area of a chain link. The asymmetric nature of the interlocking links of the chain may mean that the partially obstructed linkage opening 54 has sufficient clearance to allow one link to fit within the unobstructed portion of linkage opening 54, but adjacent links which have greater height because of their different orientation may not fit.

In some embodiments, a connecting stop piece 72 and an anchor stop piece 74 may be included on linkage member 70. As an example, stop pieces 72, 74 may be located at respective ends of linkage member 70 or optionally located at other midpoints along linkage member 70. In some embodiments stop pieces 72, 74 may be hooks or loops attached at respective ends of linkage member 70. Stop pieces 72, 74 may also be other suitable solutions that would prevent linkage member 70 from being removed from or falling into hollow pole 30 such as knots, balls, clamps, or any other objects that are larger than linkage opening 54 and which may be attached to linkage member 70.

Figure 6:
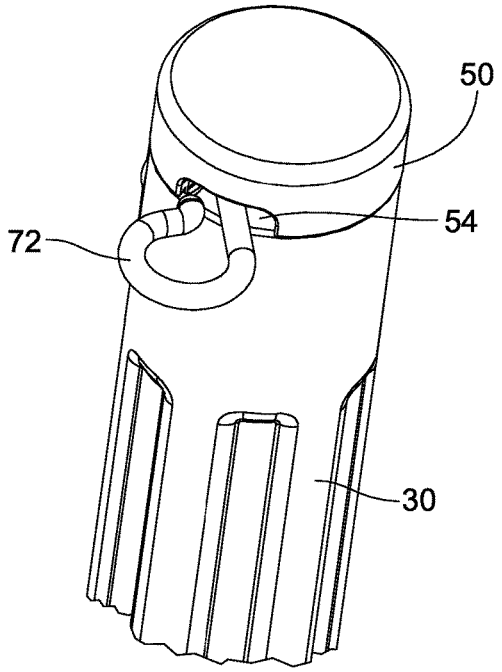
FIG. 6 is a front view of the stanchion of FIG. 1 with a stop piece located adjacent to the linkage opening.
Figure 7:
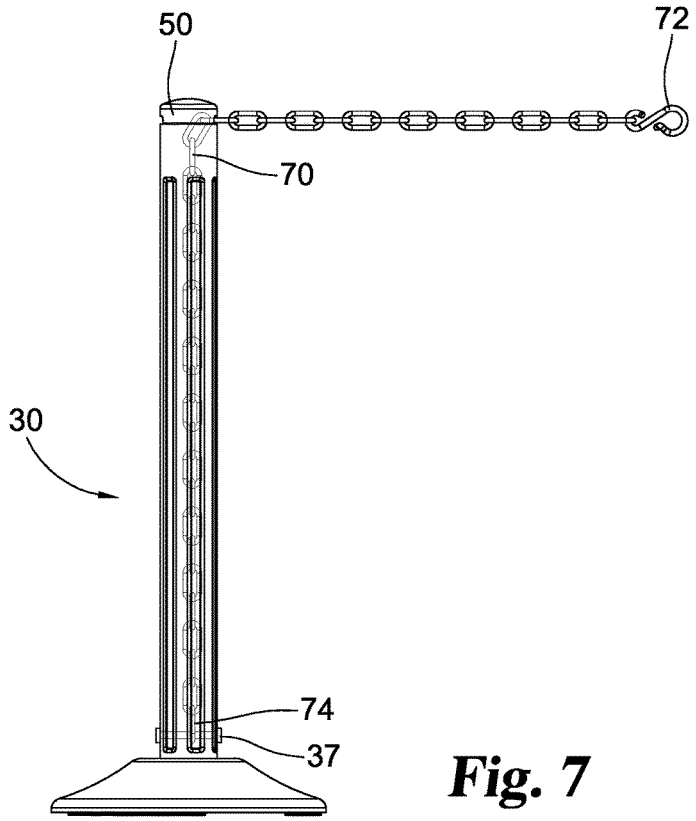
FIG. 7 is a side view of the stanchion of FIG. 1 including an anchor pin for attaching an anchor stop piece.

As shown in FIG. 7, connecting stop piece 72 is located outside of hollow pole 30 and may be configured to attach to an exterior anchor such as another stanchion 10, another linkage member, an anchor ring or the like, or other exterior objects like a wall. Anchor stop piece 74 may be located in the interior of hollow pole 30. As seen in FIG. 6, in some embodiments, a dimension of connecting stop piece 72 may be larger than a dimension of linkage opening 54, in either the raised or lowered position, to prevent connecting stop piece 72 from passing through linkage opening 54 and falling into hollow pole 30. Likewise, the width of anchor stop piece 74 may be larger than the width of linkage opening 54 to prevent linkage member 70 from being fully removed from hollow pole 30. In other embodiments, one end or neither end of linkage member 70 may include a stop piece so that linkage member 70 may be completely removed from or inserted into hollow pole 30. In order to initially thread linkage member 70 through linkage opening 54, connecting stop piece 72 and/or anchor stop piece 74 may be connected to linkage member 70 after linkage member 70 has already been inserted through linkage opening 54. Stop pieces 72 and 74 may be detachable from linkage member 70 to allow linkage member 70 to be removed from stanchion 10.

In some embodiments, anchor stop piece 74 may be connected at an anchor point within hollow pole 30 (see FIG. 7). For example, an anchor pin 37 may be inserted through pole 30, and anchor stop piece 74 may be attached to anchor pin 37. Anchor pin 37 can help prevent anchor stop piece 74 from being removed from pole 30. In other embodiments, anchor stop piece 74 may anchored to base 20 before pole 30 and base 20 are assembled.

Figure 8:
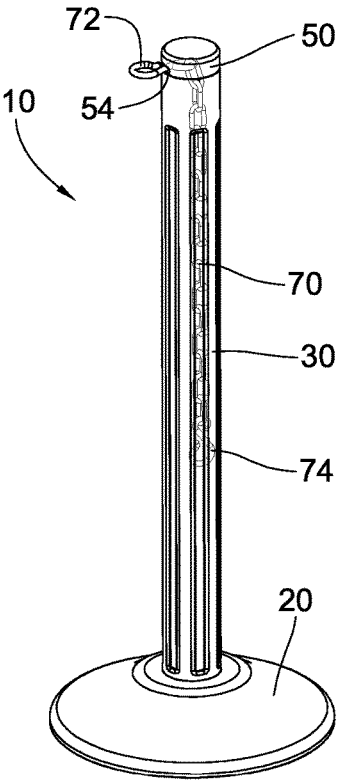
FIG. 8 is a perspective view of the stanchion of FIG. 1 with the linkage member in a storage position.

FIG. 8 is a representative illustration of a stanchion 10 in a storage configuration. The majority of the length of linkage member 70 is located within hollow pole 30. Connecting stop piece 72 is located outside of linkage opening 54. Cap piece 50 is in its lowered position so linkage member 70 cannot be pulled out of pole 30. The result is a compact configuration while the linkage member 70 is conveniently stored with the pole 30 and base 20.

Figure 9:
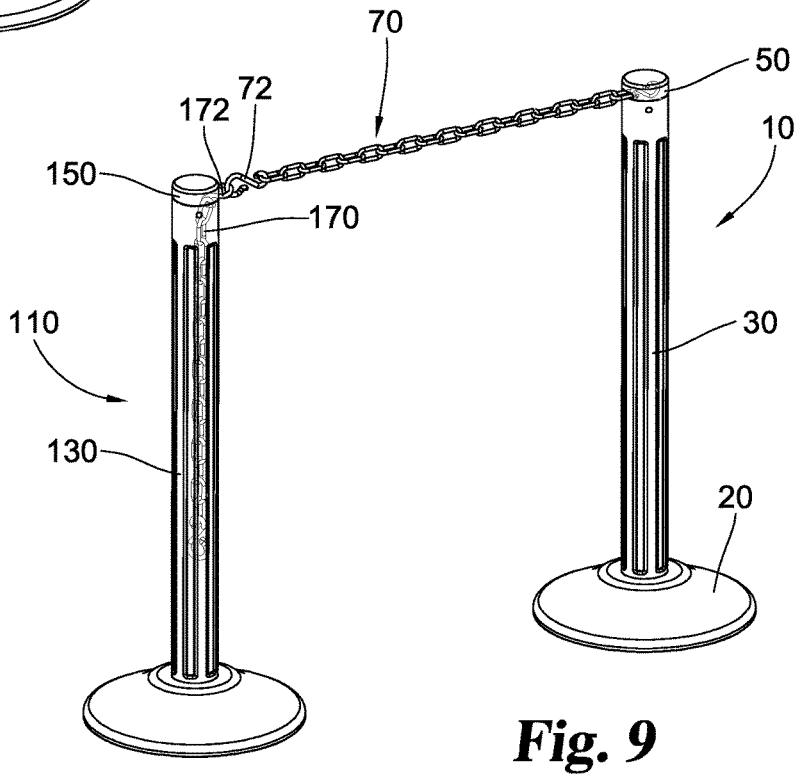
FIG. 9 is a perspective view of the two stanchions as shown in FIG. 1 linked together to form a barrier.

FIG. 9 is a representative illustration showing the use of two stanchions 10, 110 to create a barrier. Stanchion 10 has been configured so a portion of linkage member 70 extends outside of pole 30. Cap piece 50 is in its lowered position to keep linkage member 70 from being pulled further out from pole 30 or from entering pole 30 so linkage member 70 is kept at a fixed length.

Stanchion 110 is configured in the storage position, similar to what is shown in FIG. 8. Most of linkage member 170 is located within hollow pole 130. Cap piece 150 is in its lowered position, and a portion of stop piece 172 protrudes from the linkage opening (not shown) in cap piece 150. The lowered cap piece 150 prevents linkage member 170 from sliding into or out of pole 130. Connecting stop piece 72 of stanchion 10 is attached to stop piece 172 of stanchion 110 so linkage member 70 extends between stanchions 10, 110. In different embodiments, connecting stop piece 72 may be attached to another anchor, other than stop piece 172, located on stanchion 110 such as an opening or an eyebolt. Alternatively, in other embodiments, linkage member 70 may be secured to stanchion 110 by being inserted into an opening on stanchion 110 that is larger than stop piece 72 to allow insertion of an end of linkage member 70. Cap piece 150 may be lowered to hold linkage member 70 and secure it to stanchion 110.

Figure 10:
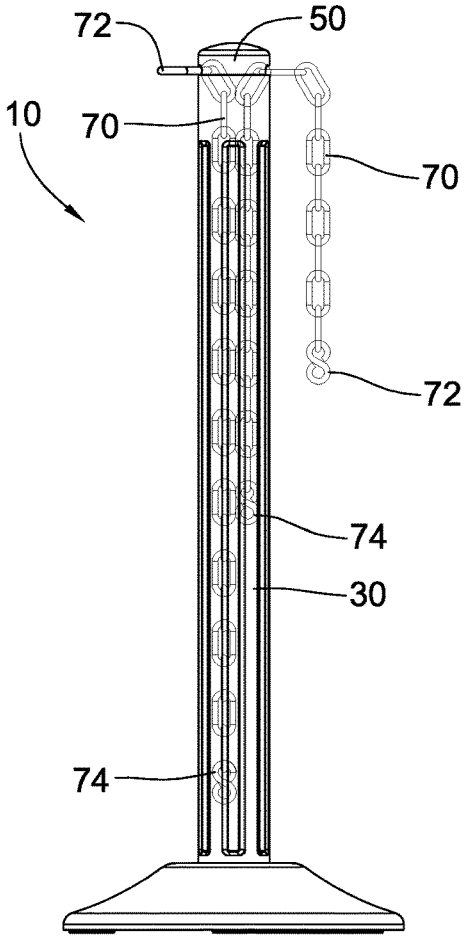
FIG. 10 is a side view of a stanchion with two linkage members.

In some embodiments, stanchion 10 may include more than one linkage member 70 (see FIG. 10). In these embodiments, cap piece 50 has multiple linkage openings 54 and a linkage member 70 is inserted through each of the linkage openings 54. Each linkage member 70 may extend in a different direction to allow stanchion 10 to be attached to multiple objects. For example, stanchion 10 may be a part of a series of stanchions that are used to form a crowd barrier. One linkage member 70 may extend to an adjacent stanchion in the series while another linkage member 70 included in stanchion 10 may attach to a different adjacent stanchion in the series.

Figure 11:
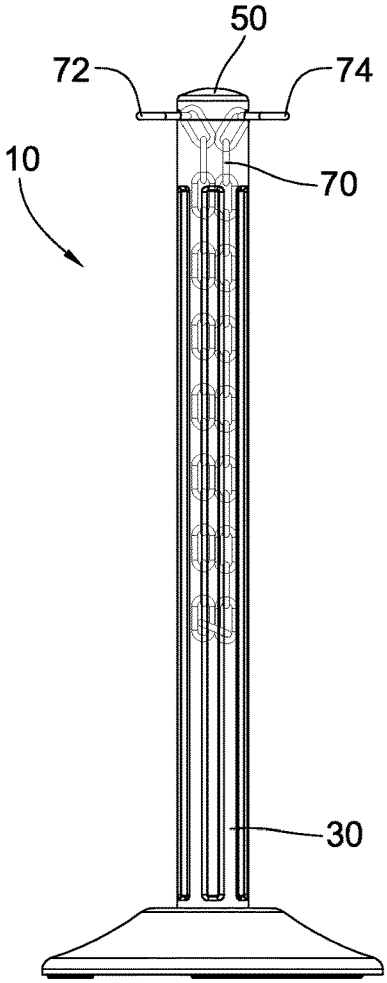
FIG. 11 is a side view of a stanchion with a linkage member that may extend to either side of the stanchion.

In other embodiments, stanchion 10 may be able to attach to different objects using only one linkage member 70 (see FIG. 11). In these embodiments, linkage member 70 is configured so one connecting stop piece 72 is outside of linkage opening 54 and the other anchor stop piece 74 is outside of a separate linkage opening 54. The middle portion of linkage member 70 may be stored within stanchion 10. When cap piece 50 is in the raised position, either stop piece 72, 74 of linkage member 70 may be extended from stanchion 10. If desired, only one end may be extended to a desired length while the other end remains fixed, or both stop pieces 72, 74 may be extended to desired lengths.

Figure 12:
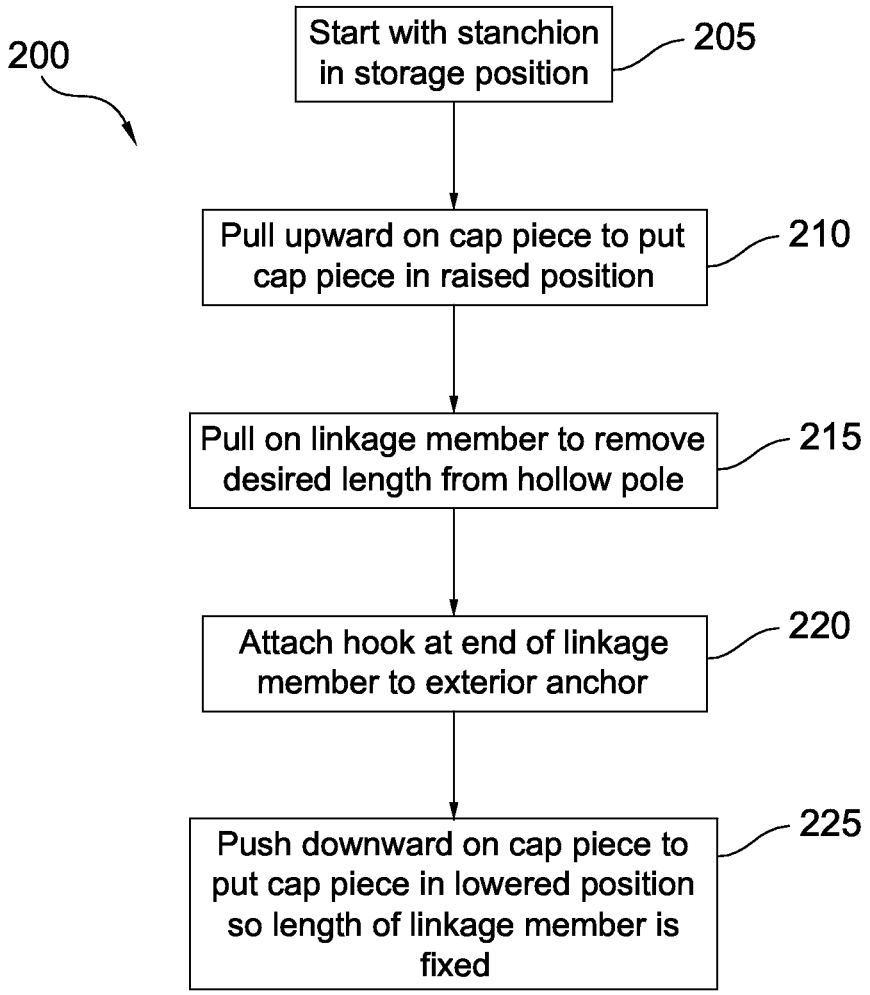
FIG. 12 is a flowchart showing a process for setting up the stanchion of FIG. 1 to act as a barrier.

FIG. 12 shows a flowchart detailing a process 200 for setting up stanchion 10 to act as a barrier. The process starts 205 with the stanchion in the storage position (shown in FIG. 7). The cap piece is then pulled 210 upward so the cap piece is placed in, and optionally retained in, its raised position.

While the cap piece is in the raised position, the linkage member is pulled from or pushed into 215 the hollow pole to a desired length. Once the linkage member is at its desired length, an exterior stop piece on the linkage member is attached 220 to an anchor such as a wall or another stanchion to form a barrier. Then, once linkage member has been anchored and the desired length of the linkage member has been reached, the cap piece is pushed downward until the remaining opening area of the linkage opening is sized to keep the linkage member in place 225. This prevents the length of the linkage member outside the pole from changing. The cap piece may be retained in its lowered position.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A stanchion comprising:

a base;

a pole including a hollow interior portion, wherein said pole extends upward from said base;

a cap piece including a lower portion and an upper portion, wherein said lower portion extends inside said hollow pole;

at least one linkage opening defined through said cap piece;

a linkage member including a length, wherein said linkage member passes through said linkage opening so a portion of said linkage member is within said pole and a portion of said linkage member is outside of said pole; and wherein said cap piece is vertically movable within said pole between a raised position and a lowered position;

wherein when said cap piece is in said raised position, a portion of said linkage opening that is unobstructed by said pole is sized so said length of said linkage member is removable from or insertable into said interior portion of said pole through said linkage opening; and wherein when said cap piece is in said lowered position, the portion of said linkage opening unobstructed by said pole is sized to restrict movement of said linkage member so that said linkage member cannot travel through the linkage opening along the length of the linkage member.

2. The stanchion of claim 1, wherein said cap piece is rotatable within said pole.

3. The stanchion of claim 1, comprising:

a pin located in said interior portion of said pole;

a path defined in said lower portion of said cap piece for engaging said pin, and wherein said path includes a vertical portion and a horizontal portion.

4. The stanchion of claim 3, wherein said pin can be located in said horizontal portion of said path to retain said cap piece in the raised position.

5. The stanchion of claim 3, wherein said pin can be located in said vertical portion of said path to allow said cap piece to be moved to the lowered position.

6. The stanchion of claim 1, wherein said linkage member is a chain.

7. The stanchion of claim 1, comprising:

a first stop piece attached to one end of said linkage member, wherein said first stop piece is sized so that said first stop piece may not pass through said linkage opening.

8. The stanchion of claim 7, comprising:

a second stop piece attached to the opposite end of said linkage member, wherein said second stop piece is sized so that said second stop piece may not pass through said linkage opening.

9. The stanchion of claim 1, wherein one end of said linkage member is located in said interior portion of said pole and the other end of said linkage member is outside of said pole.

10. The stanchion of claim 1, comprising two linkage openings through said cap piece.

11. The stanchion of claim 10, comprising a second linkage member, wherein said second linkage member passes through one of said linkage openings and wherein said second linkage member is feedable through said one of said linkage openings.

12. A stanchion comprising:

a base;

a pole including a hollow interior portion, wherein said pole extends upward from said base;

a pin located in said interior portion of said pole;

a cap piece including a lower portion and an upper portion, wherein said lower portion of said cap piece includes a path with a horizontal path segment and a vertical path segment with said pin engaged with said path;

at least one linkage opening through said cap piece;

a linkage member including two ends, wherein said linkage member passes through said linkage opening;

wherein when said cap piece is in a raised position, said linkage member is feedable through said linkage opening; and, wherein when said cap piece is in a lowered position, said linkage member is not able to move through said linkage opening.

13. The stanchion of claim 12, wherein said pin engages said vertical path segment when said cap piece is in the raised position and wherein said pin engages said horizontal path segment when said cap piece is in the lowered position.

14. The stanchion of claim 12, wherein one end of said linkage member is positioned within the interior of said hollow pole.

15. The stanchion of claim 12, comprising two linkage openings through said cap piece.

16. The stanchion of claim 15, wherein said linkage member passes through both of said two linkage openings and wherein both ends of said linkage member are located outside of said hollow pole and at least a part of said linkage member is located in the interior portion of said pole.

17. The stanchion of claim 15, comprising a second linkage member, wherein said second linkage member is inserted through one of said linkage openings and wherein said second linkage member is feedable through said linkage opening when said cap piece is in said raised position.

18. The stanchion of claim 12, wherein said linkage member is a chain.

19. The stanchion of claim 12, comprising:

a first stop piece attached to one end of said linkage member, wherein said first stop piece is sized so that said first stop piece may not pass through said linkage opening.

20. The stanchion of claim 19, comprising:

a second stop piece attached to the opposite end of said linkage member, wherein said second stop piece is sized so that said second stop piece may not pass through said linkage opening.

* * * * *